United States Patent [19]

Breitweiser et al.

[11] 4,414,725

[45] Nov. 15, 1983

[54] METHOD FOR TURBOCHARGER REPAIR

[76] Inventors: Steve Breitweiser, 744 N. 2nd Ave., Villa Park, Ill. 60181; David Nelson, 210 N. Broadway, Park Ridge, Ill. 60068

[21] Appl. No.: 231,401

[22] Filed: Feb. 4, 1981

Related U.S. Application Data

[63] Continuation-in-part of Ser. No. 28,072, Apr. 9, 1979, abandoned.

[51] Int. Cl.[3] ..... F02B 37/00

[52] U.S. Cl. ..... 29/156.4 R; 29/402.08; 29/402.14; 60/605

[58] Field of Search ..... 60/605; 417/236, 238, 417/407, 572; 415/189, 190, 201, 219 R, DIG. 3; 123/DIG. 1, DIG. 7; 137/315, 15; 29/156.8 CF, 156.4 R, 401.1, 402.08–402.14

[56] References Cited

U.S. PATENT DOCUMENTS 3,411,706 11/1968 Woollenweber et al. ..... 417/407

*Primary Examiner*—Michael Koczo

*Attorney, Agent, or Firm*—Howard H. Darbo

[57] ABSTRACT

An adapter for a turbocharger allows an engine to operate naturally aspirated when the turbine-compressor cartridge is removed, as for repair, by procedures employing the method of the invention. A plate or a pair of plates or a plate plus conduit means for connecting the carburetor directly to the intake manifold are used to replace the turbine and compressor thereby completely closing off the turbine or the turbine and the compressor portions of the turbo housing. When, after the turbine-compressor cartridge has been removed, the compressor and turbine portions of the turbo housing are sealed in this manner, or the turbine portion has been sealed and the compressor portion bypassed, the engine will operate as a conventional, naturally aspirated, engine.

3 Claims, 6 Drawing Figures

METHOD FOR TURBOCHARGER REPAIR

RELATED APPLICATION

This application is a continuation-in-part of Applicants' patent application Ser. No. 28,072, filed Apr. 9, 1979, now abandoned, and entitled "Adapter for Turbocharger."

BACKGROUND OF THE INVENTION

This invention is directed to a method for repairing turbochargers of internal combustion engines and to an adapter that may be secured to the housing of the turbocharger when the turbine-compressor cartridge is removed therefrom. The repair procedure and adapter of this invention allows the engine to operate naturally aspirated with the burbocharger cartridge removed.

It is common practice to incorporate turbochargers on internal combustion engines to increase power and efficiency. The turbocharger is an exhaust-driven air compressor which forces a highly pressurized air or air/fuel mixture into the engine. The pressurized air or air/fuel mixture enables the engine to develop more power than when it is naturally aspirated.

The turbocharger consists of two main components, a hot gas turbine and a compressor, each joined to the other by a common shaft. The turbine is connected to the engine's exhaust manifold, and the compressor is connected to the engine's intake manifold.

In operation, engine exhaust gases are routed into the turbine and cause the turbine wheel to rotate at very high speed. A wheel, located in the compressor section of the turbo, is attached to the other end of the common shaft with the turbine wheel, and spins at the same high speed therewith. The spinning compressor wheel draws the air or air/fuel mixture from the manifold or carburetor into the compressor chamber where the mixture is then compressed and made more dense. The compressed air or air/fuel mixture is expelled through the outlet of the compressor chamber and into the engine's intake manifold. When the dense air of air/fuel mixture reaches the cylinders and is burned, a significant increase in torque and horsepower is produced.

The turbocharger uses the engine's otherwise wasted energy from the exhaust to get free power to supercharge the engine with dense fresh air and fuel. The net result is an increase in power. However, the main disadvantage of turbochargers is that should they malfunction, the engine cannot be operated. This, in effect, is a complete breakdown of the engine caused by the malfunction of an accessory component.

Therefore, it is a primary object of the present invention to provide a method and means which will allow a turbocharged engine to be operated as a naturally aspirated engine during periods when the turbo cartridge is removed for repair.

Another object of the present invention is to provide a method and means which will allow a turbocharged engine to be converted back to a naturally aspirated engine without requiring removal of the turbo housing.

A feature of the present invention is the use of turbo plate adapter means to seal the turbine section of the turbo and form a continuous exhaust passage, and means to seal the compressor section of the turbo and form a continuous intake passage, thereby restoring the engine to a naturally aspirated configuration.

Many other objects, features, and advantages of the present invention will be more fully realized and understood from the following detailed description when taken in conjunction with the accompanying drawings wherein like reference numeral throughout the various views of the drawings are intended to designate similar elements and components, and wherein:

DETAILED DESCRIPTION OF THE ILLUSTRATED EMBODIMENT

Figure 1:
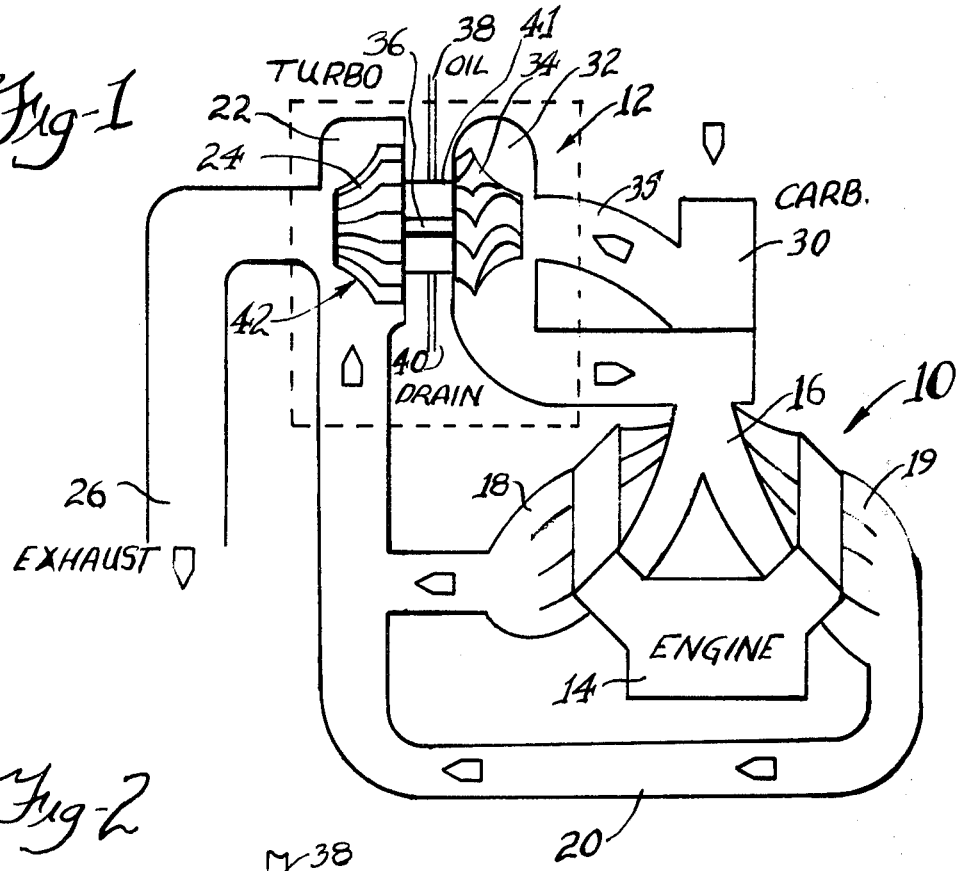
FIG. 1 is a schematic diagram of an intake and exhaust system of an engine using a turbocharger.

Referring now to FIG. 1 there is seen a schematic diagram of an engine with its intake and exhaust systems and is designated generally by reference numberal 10. A turbocharger 12 is interposed within the intake and exhaust systems and may be of any standard design. The turbo 12 may also be of an advanced design not heretofore in common use, but which will be capable of using the features of the present invention. An engine 14 is provided with an intake manifold 16 and exhaust manifolds 18 and 19. The exhaust manifolds 18 and 19 are tied together in common positions by means of a crossover pipe 20. The hot gases from the exhaust manifolds 18 and 19 are supplied to a turbine section 22 of the turbo 12 where a turbine wheel 24 is rotated at a speed which is proportional to the exhaust pressure produced by the engine. The hot gases, after causing the turbine wheel to rotate, are expelled through an exhaust pipe 26.

The engine 12 receives an air/fuel mixture by means of a carburetor 30. The carburetor 30 is connected to a compressor chamber 32 through a pipe 35 and the arrow within the pipe 35 indicates the direction of flow of the air/fuel mixture. The arrows within the intake system indicate the direction of flow of the air/fuel mixture, while the arrows within the exhaust system indicates the direction of flow of the burned hot exhaust gases.

The compressor 32 includes a compressor wheel 34 which is driven at the same speed as the turbine wheel 24 by means of a common shaft 36. The shaft 36 is lubricated by an oil line 38 and an oil drain 40 is provided to remove excess oil. The combination of components comprising the turbine wheel 24, compressor wheel 34, shaft 36 and a center cover 41, are commonly known as the cartridge 42. The functional, that is, the moving, working structure of the cartridge comprises the turbine, the compressor wheel and the shaft. The cartridge 42 is removable from the turbocharger 12 for repair and/or replacement. However, when the cartridge 42 is removed from the turbocharger, the intake and exhaust passages are interrupted by openings to atmosphere and the engine 14 cannot be operated. Thus, the malfunction of an accessory component, the turbocharger 12, will cause a major breakdown of the vehicle in which the engine 14 is mounted.

In accordance with the method and a primary object of the present invention, means are provided to seal the intake and exhaust passages of the engine 14 when the cartridge 42 is removed for repair, thereby allowing the engine to operate as a naturally aspirated engine.

Figure 2:
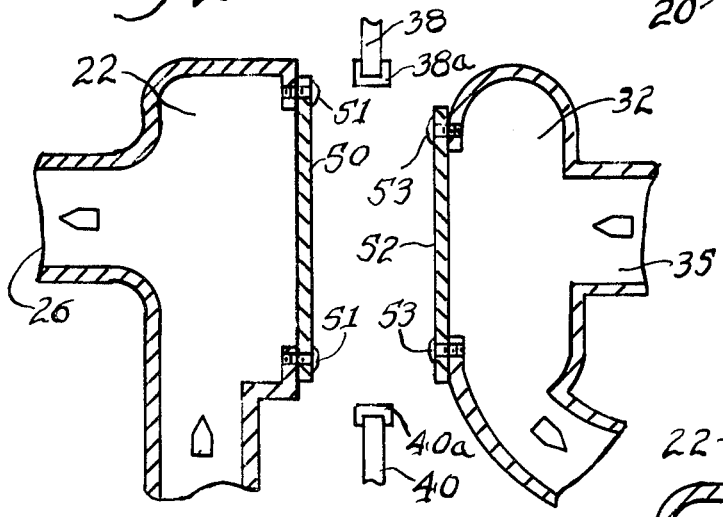
FIG. 2 is an elevational sectional view of a turbocharger housing fitted with the adapter plate means of the present invention.

Referring now to FIG. 2 there is seen one form of the present invention. The cartridge 42 has been removed from the turbocharger 12 and the oil line 38 and drain 40 are sealed by caps 38*a and* 40*a* respectively. A first turbo adapter plate 50 is secured to the turbine section 22 of the turbocharger housing to cover the opening formed therein, and a second turbo adapter plate 52 is secured to the compressor section 32 of the turbocharger housing to cover the opening formed therein. The adapter plate 50 may be fastened by means of bolts 51 while the adapter plate 52 may be fastened by means of bolts 53. While bolts 51 and 53 are shown it will be understood that clamps may be used in a manner well known in the art. This form of invention therefore provides a pair of turbo adapter plates to close and seal the openings in the passages which are normally closed by the turbocharger cartridge. The engine 14 can then operate in a conventional naturally aspirated manner and the vehicle can be used while the turbocharger cartridge is being repaired.

In some cases the compressor chamber can be eliminated after the cartridge is removed. In such cases the intake passage 35 is connected directly or indirectly to the intake manifold 16. Therefore, the second plate 52 is not required, only one plate to cover the exhaust system is needed.

Figure 4:
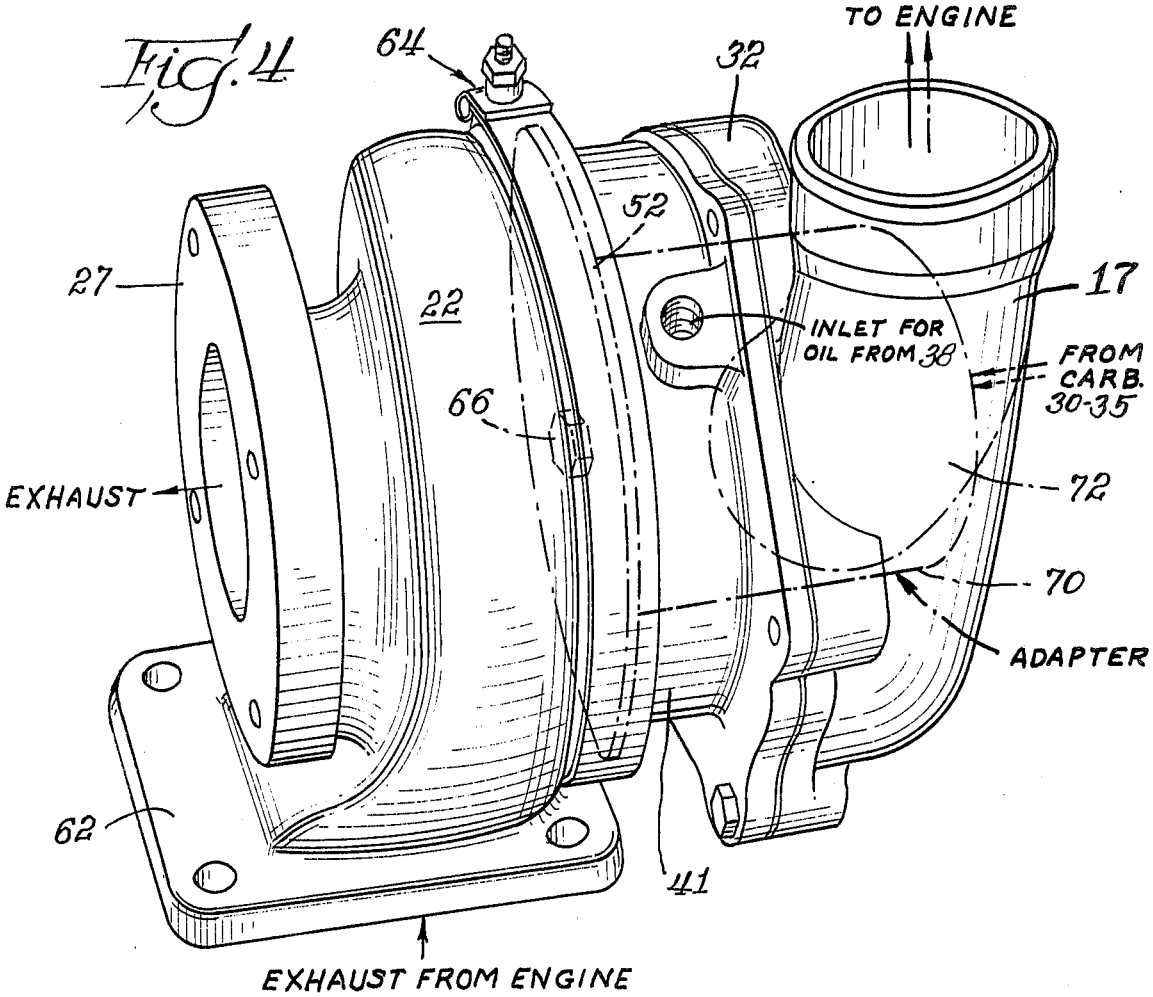
FIG. 4 is a perspective view of a common type of turbocharger.

An example of a turbocharger that can quickly and conveniently be opened, the cartridge removed for repair, and an adapter put in place to bypass the turbocharger to permit the engine to operate is shown in FIG. 4. This typical turbocharger of this type is supported by its base 62 as by bolting to the exhaust manifold. The turbine section 22 is usually an integral part of a casting which includes base 62 and a flange 27 for connection to an exhaust pipe. The compressor chamber 32 portion of the turbocharger is bolted to the intermediate cover 41 which houses the bearings for a drive shaft 36, not shown in FIG. 4, and this cover is secured to turbine section 22 by means of the V-clamp 64. The intake pipe or snout, not seen in FIG. 4, receives the air/fuel mixture from the carburetor for introduction into the compressor chamber 32 and an outlet snout 17 provides connection of the compressor chamber to the engine.

When the turbocharger shown in FIG. 4 fails and requires repair, the subassembly of compressor chamber section 32 and cartridge including intermediate cover 41 is removed from the turbine section by loosening the V-clamp 64. The turbine wheel 24, not shown in FIG. 4, can then be withdrawn from the turbine section 22, leaving the turbine section open.

Figure 5:
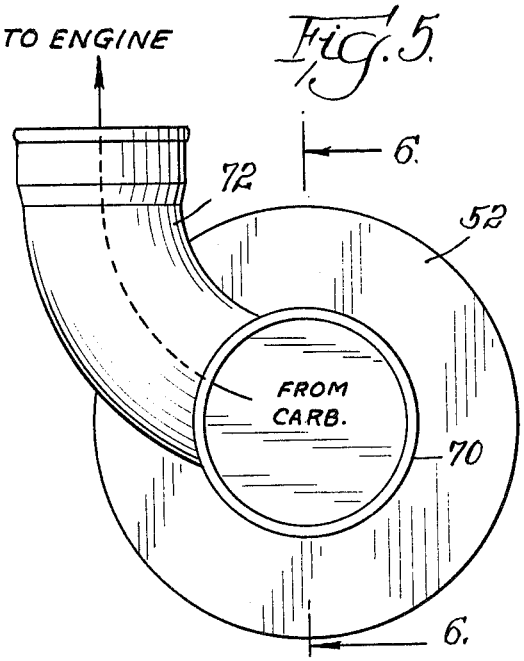
FIG. 5 is a plan view of an adapter suitable for use with the turbocharger of FIG. 4.
Figure 6:
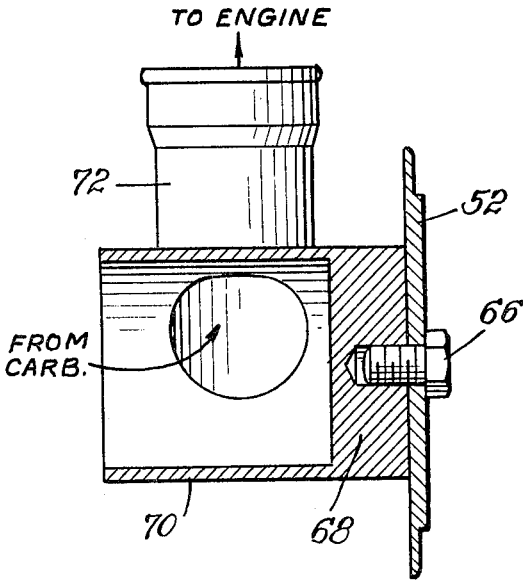
FIG. 6 is a cross-sectional view taken at line 6—6 of FIG. 5.

The adapter for application to turbine section 22 in accordance with the method of the invention is illustrated in FIGS. 5 and 6. It consists of an adapter plate 52 which is fastened by means of bolt 66 to the closed end 68 of tubular element 70. A snout 72, shown as an elbow in FIG. 5, which opens into tubular element 70, provides means for connection with intake manifold 16.

The adapter shown in FIGS. 5 and 6 is shown in dash dot lines in FIG. 4 when secured to turbine section 22 in place of the subassembly portion of the turbocharger that was removed. The adapter closes the open turbine section by means of adapter plate 52 and provides a connection in the intake line from the carburetor 30 to the engine. The engine is then in condition to operate, albeit without the turbocharger.

The adapter can be used with this type of turbocharger in different sizes, the diameter of plate 52 being of the size necessary to close the open side of turbine section 22.

Figure 3:
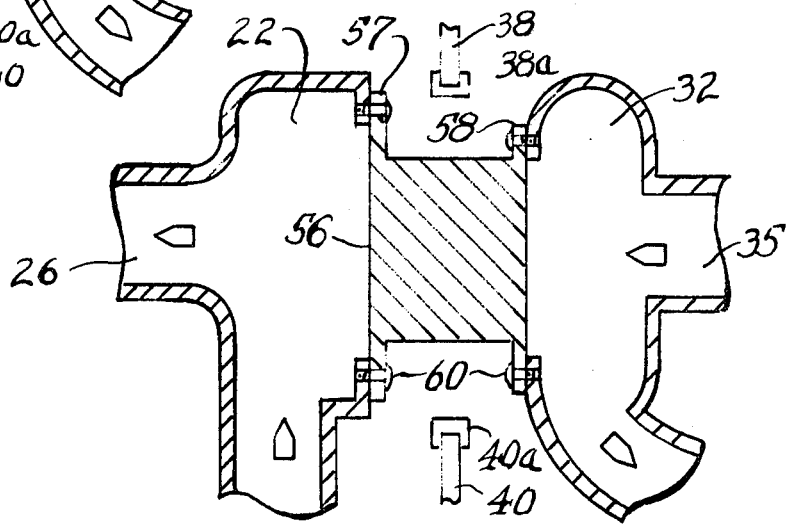
FIG. 3 is an elevational sectional view of a turbocharger housing fitted with another form of adapter plate means of the present invention.

Referring to FIG. 3 there is seen another form of the present invention. Here the adapter means takes the form of a single unit 56 having flanges 57 and 58 which are sized to cover the turbine chamber 22 and the compressor chamber 32, respectively. The flanges 57 and 58 are fastened by means of bolts or screws 60 to securely hold the adapter unit 56 in place. Here also, the unwanted openings in the intake and exhaust passages are sealed and the engine can operate in a naturally aspirated manner.

While the illustrated embodiment shows an engine using a carburetor for the distribution of an air/fuel mixture it will be understood that a diesel engine may use the improvements of this invention as well. However, the diesel engine will pass only air through the compressor chamber and the fuel will be added to the cylinders by means of injectors as is well known in the art.

While three forms of the present invention are illustrated herein it will be understood that other variations and modifications may be made without departing from the spirit and scope of this invention.

We claim:

1. The method for repairing a failed engine turbocharger having a turbine section, a compressor chamber section connected into the fuel/air engine intake conduit and a turbine/compressor cartridge, which comprises the steps of temporarily converting the engine to a naturally aspirated engine by first removing the cartridge from the turbocharger leaving said turbine section open to the atmosphere and the fuel/air engine intake conduit open to the atmosphere, then closing the opening thereby left in the turbine section by fastening a plate over said opening and providing connection means completing the fuel/air conduit to the engine, and thereafter removing the plate and the connection means and installing an operative cartridge to complete the repair of the turbocharger.

2. The method of claim 1 wherein the connection means comprises a plate secured in the opening into the compressor chamber section left by the removal of the cartridge therefrom.

3. The method for repairing a failed engine turbocharger having a turbine section, a compressor chamber section and a turbine/compressor cartridge, which comprises the steps of temporarily converting the engine to a naturally aspirated engine by first removing the cartridge and the compressor chamber section from the turbocharger leaving said turbine section and the fuel/air engine intake conduit open to the atmosphere, then inserting an adapter in place of the cartridge, said adapter comprising a plate covering the opening left in the turbine section by removal of the cartridge and a conduit section connected into and completing the fuel/air conduit to the engine, and thereafter removing the adapter and installing an operative cartridge to complete the repair of the turbocharger.

* * * * *